US009412509B2

(12) United States Patent
Im et al.

(10) Patent No.: US 9,412,509 B2
(45) Date of Patent: Aug. 9, 2016

(54) MULTILAYER ELECTRONIC COMPONENT HAVING CONDUCTIVE PATTERNS AND BOARD HAVING THE SAME

(71) Applicant: SAMSUNG ELECTRO-MECHANICS CO., LTD., Suwon-Si, Gyeonggi-Do (KR)

(72) Inventors: Jeong Hwan Im, Suwon-Si (KR); So Young Jun, Suwon-Si (KR); Hyun Ju Jung, Suwon-Si (KR); Sung Jin Park, Suwon-Si (KR); Young Jin Ha, Suwon-Si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/504,107

(22) Filed: Oct. 1, 2014

(65) Prior Publication Data

US 2015/0371755 A1 Dec. 24, 2015

(30) Foreign Application Priority Data

Jun. 24, 2014 (KR) ..... 10-2014-0077158

(51) Int. Cl.
*H01F 27/28* (2006.01)

(52) U.S. Cl.
CPC .... *H01F 27/2804* (2013.01); *H01F 2027/2809* (2013.01)

(58) Field of Classification Search
CPC ..... H01F 5/00; H01F 27/02; H01F 7/06; H01F 5/02; H01H 9/00; H01H 51/22; H01H 21/8222
USPC ..... 257/686, 685, 531, 421, 414; 361/765, 361/763, 764, 773; 336/200, 83, 192, 223, 336/188, 208, 232
See application file for complete search history.

(56) References Cited

U.S. PATENT DOCUMENTS 5,225,969 A * 7/1993 Takaya ..... H01L 27/013 174/255
6,165,866 A * 12/2000 Kobayashi ..... H01G 4/30 438/329
6,445,593 B1 * 9/2002 Okuyama ..... H01F 17/0013 257/421
6,466,120 B1 * 10/2002 Tokuda ..... H01F 17/0013 336/192
6,580,350 B1 * 6/2003 Kobayashi ..... H01F 17/0013 336/192
9,178,483 B1 * 11/2015 Park ..... H03H 7/0115
2002/0125547 A1 * 9/2002 Kawase ..... H01C 1/16 257/531
2009/0243784 A1 * 10/2009 Iwasaki ..... H01F 17/0013 336/200
2010/0127812 A1 * 5/2010 Maeda ..... H01F 17/0013 336/200

(Continued)

FOREIGN PATENT DOCUMENTS

JP 11-297531 * 10/1999
JP 2000-348939 * 12/2000

(Continued)

*Primary Examiner* — Alexander Oscar Williams
(74) *Attorney, Agent, or Firm* — McDermott Will & Emery LLP

(57) ABSTRACT

A multilayer electronic component may include: a multilayer body including a plurality of insulating layers; an internal coil part provided by electrically connecting respective conductive patterns disposed on the plurality of insulating layers to each other; and first and second external electrodes disposed on both end surfaces of the multilayer body, respectively. A perimeter of at least one conductive pattern disposed in peripheral regions of the multilayer body may be smaller than a perimeter of a conductive pattern disposed in a central region of the multilayer body.

17 Claims, 6 Drawing Sheets

(56) References Cited

U.S. PATENT DOCUMENTS

| | | | | |
|---|---|---|---|---|
| 2012/0056705 | A1* | 3/2012 | Kim | H01F 17/0033 336/200 |
| 2013/0214888 | A1* | 8/2013 | Nogi | H01F 17/0013 336/192 |
| 2014/0097923 | A1* | 4/2014 | Naito | H01F 17/0033 336/83 |

FOREIGN PATENT DOCUMENTS

| | | | |
|---|---|---|---|
| JP | 2000-353618 | * | 12/2000 |
| JP | 2001-126925 | * | 12/2000 |
| JP | 2002-93636 | * | 3/2002 |
| JP | 2003-077728 | A | 3/2003 |
| JP | 2004-014549 | A | 1/2004 |

* cited by examiner

I-I'

MULTILAYER ELECTRONIC COMPONENT HAVING CONDUCTIVE PATTERNS AND BOARD HAVING THE SAME

CROSS-REFERENCE TO RELATED APPLICATION

This application claims the benefit of Korean Patent Application No. 10-2014-0077158 filed on Jun. 24, 2014, with the Korean Intellectual Property Office, the disclosure of which is incorporated herein by reference.

BACKGROUND

The present disclosure relates to a multilayer electronic component and a board having the same.

An inductor, an electronic component, is a representative passive element configuring an electronic circuit together with a resistor and a capacitor to remove noise.

Among multilayer electronic components, a multilayer inductor may have a structure in which conductive patterns are formed on insulating layers using a magnetic material or a dielectric material as a main material, the insulating layers having the conductive patterns formed thereon are stacked to form an internal coil part within a multilayer body, and external electrodes for electrically connecting the internal coil part to an external circuit are formed on outer surfaces of the multilayer body.

The internal coil part is formed within the multilayer body to generate inductance. A vertical multilayer inductor in which the internal coil part is disposed in a direction perpendicular to a mounting surface of a board in order to generate relatively high inductance has been known.

The vertical multilayer inductor may obtain higher inductance than a multilayer inductor in which the internal coil part is disposed in a horizontal direction, and may increase a magnetic resonance frequency.

RELATED ART DOCUMENT (Patent Document 1) Japanese Patent Laid-Open Publication No. 2003-077728

SUMMARY

An exemplary embodiment in the present disclosure may provide a multilayer electronic component having reduced parasitic capacitance, and a board having the same.

According to an exemplary embodiment in the present disclosure, the perimeter of at least one conductive pattern disposed in peripheral regions of a multilayer body may be smaller than the perimeters of conductive patterns disposed in a central region of the multilayer body.

BRIEF DESCRIPTION OF DRAWINGS

The above and other aspects, features and advantages in the present disclosure will be more clearly understood from the following detailed description taken in conjunction with the accompanying drawings, in which.

DETAILED DESCRIPTION

Figure 1:
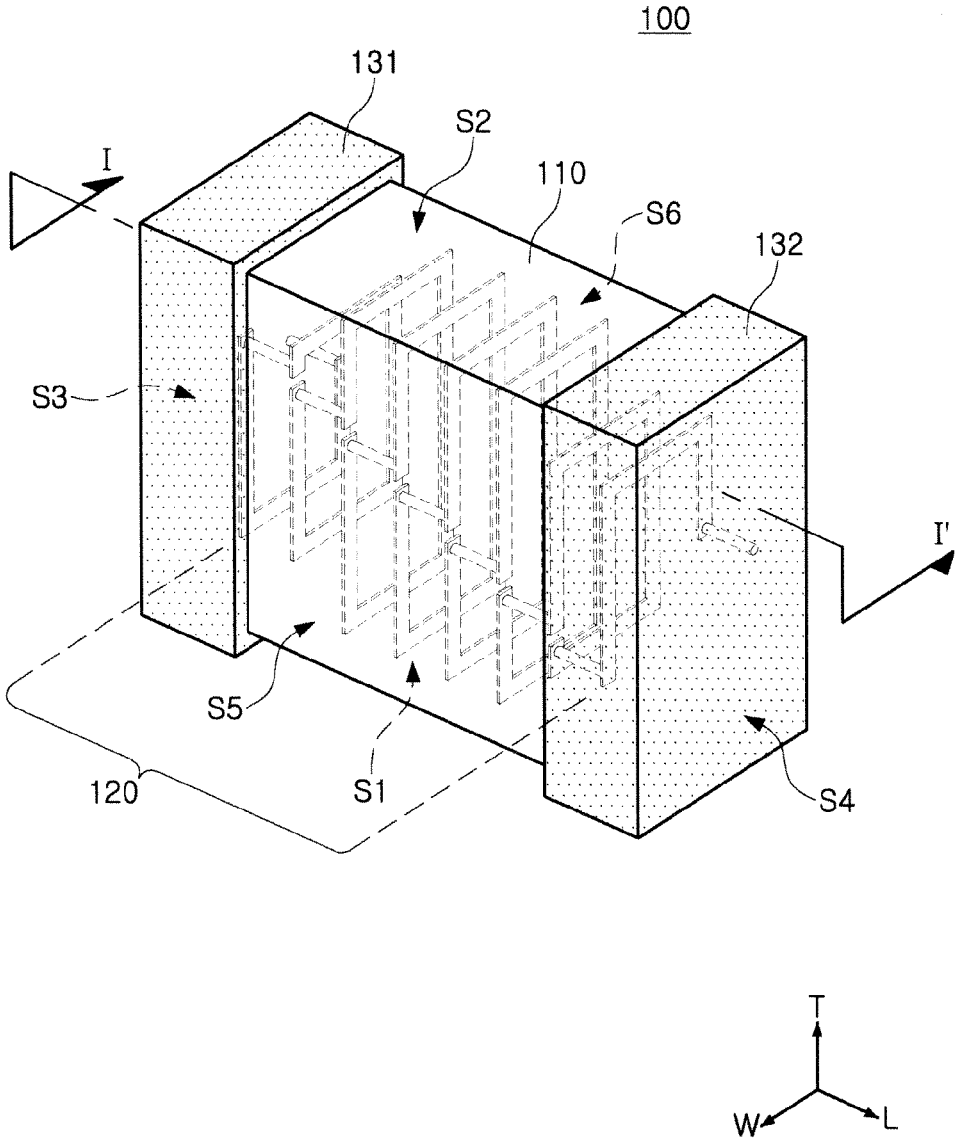
FIG. 1 is a schematic perspective view of a multilayer electronic component having an internal coil part according to an exemplary embodiment in the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Multilayer Electronic Component

Hereinafter, a multilayer electronic component according to an exemplary embodiment in the present disclosure. In particular, a multilayer inductor will be described as an example, and the present disclosure is not limited thereto.

FIG. 1 is a schematic perspective view of a multilayer electronic component having an internal coil part according to an exemplary embodiment in the present disclosure.

Referring to FIG. 1, a multilayer electronic component according to this exemplary embodiment in the present disclosure may include a multilayer body 110, an internal coil part 120, and first and second external electrodes 131 and 132.

The perimeter of at least one conductive pattern disposed in peripheral regions of the multilayer body 110 among conductive patterns forming the internal coil part 120 may be smaller than the perimeters of conductive patterns disposed in a central region of the multilayer body 110 among the conductive patterns.

The perimeters of conductive patterns 121 disposed in regions of the multilayer body 110 adjacent to the first and second external electrodes 131 and 132 may be reduced, such that distances between the first and second external electrodes 131 and 132 and the conductive patterns 121 are increased, whereby parasitic capacitance may be decreased.

In the multilayer electronic component 100 according to the exemplary embodiment in the present disclosure, a length direction' refers to an 'L' direction of FIG. 1, a 'width direction' refers to a 'W' direction of FIG. 1, and a 'thickness direction' refers to a 'T' direction of FIG. 1.

The multilayer body 100 may have lower and upper surfaces S1 and S2 opposing each other in the thickness T direction, both side surfaces S5 and S6 opposing each other in the width W direction, and both end surfaces S3 and S4 opposing each other in the length L direction.

The multilayer electronic component 100 according to the exemplary embodiment in the present disclosure may have a form in which a thickness T of the multilayer body 110 is larger than a width W of the multilayer body 110 in order to generate a high inductance.

A general multilayer electronic component has been manufactured so that a width and a thickness thereof are substantially the same as each other.

However, in the multilayer electronic component 100 according to the exemplary embodiment in the present disclosure, since the thickness T of the multilayer body 110 is larger than the width W of the multilayer body 110, even in the case that a mounting area occupied by the multilayer electronic component is not increased at the time of mounting the multilayer electronic component on a board, a magnetic path area may be increased, whereby relatively high inductance may be obtained.

In the case in which the thickness T of the multilayer body 110 is larger than the width W of the multilayer body 110 as in the exemplary embodiment in the present disclosure, a high inductance may be secured. However, an area of the internal coil part 120 may be increased as compared with a general multilayer electronic component, whereby parasitic capacitance may also be increased.

However, according to the exemplary embodiment in the present disclosure, the perimeters of the conductive patterns disposed in the regions adjacent to the first and second external electrodes 131 and 132 are reduced and the distances between the first and second external electrodes 131 and 132 and the conductive patterns 121 are increased, whereby the above-mentioned problem may be solved.

Figure 2:
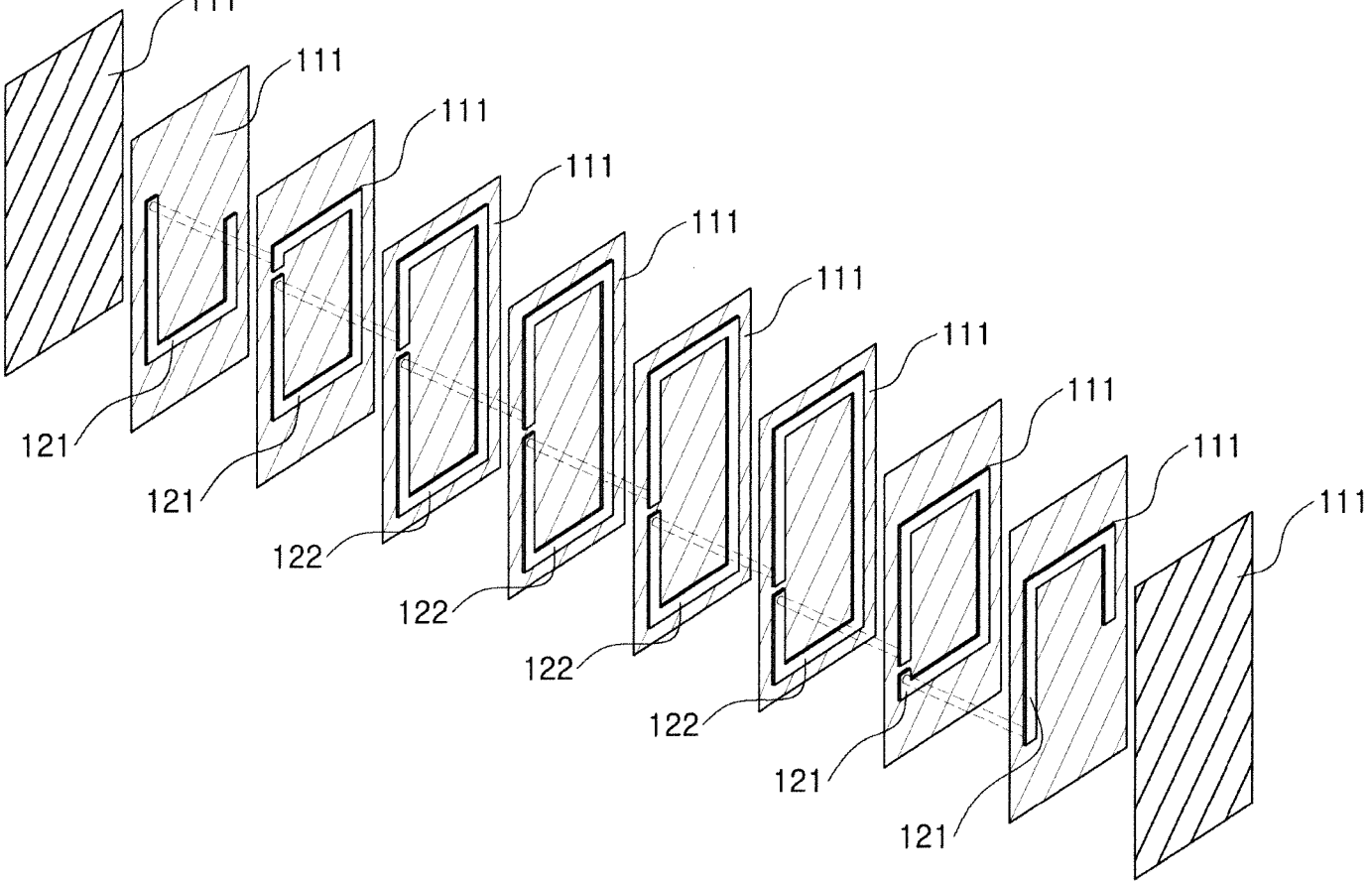
FIG. 2 is an exploded perspective view of a multilayer body according to an exemplary embodiment in the present disclosure.

FIG. 2 is an exploded perspective view of a multilayer body according to an exemplary embodiment in the present disclosure.

Referring to FIG. 2, the multilayer body 110 may include a plurality of insulating layers 111 and conductive patterns 121 and 122 formed on the insulating layers 111.

A raw material forming the insulating layer 111 may be known ferrite such as Mn—Zn-based ferrite, Ni—Zn-based ferrite, Ni—Zn—Cu-based ferrite, Mn—Mg-based ferrite, Ba-based ferrite, Li-based ferrite, or the like, but is not limited thereto.

The multilayer body 110 may be formed by stacking the plurality of insulating layers 111, and the plurality of insulating layers 111 forming the multilayer body 110 may be in a sintered state. In addition, adjacent insulating layers 111 may be integrated with each other so that boundaries therebetween are not readily apparent without a scanning electron microscope (SEM).

The internal coil part 120 may be formed by electrically connecting the conductive patterns 121 and 122 formed at a predetermined thickness on the plurality of insulating layers 111 to each other.

The perimeters of the conductive patterns 121 disposed in the peripheral regions may be smaller than the perimeters of the conductive patterns 122 disposed in the central region.

The conductive patterns 121 and 122 may be formed by applying a conductive paste containing a conductive metal on the insulating layers 111 using a printing method, or the like. As a method of printing the conductive paste, a screen printing method, a gravure printing method, or the like, may be used. However, the present disclosure is not limited thereto.

Vias may be formed at predetermined positions in the respective insulating layers 111 on which the conductive patterns 121 and 122 are printed, and the conductive patterns 121 and 122 formed on the respective insulating layers 111 may be electrically connected to each other through the vias to form a single internal coil part 120.

Here, the conductive patterns 121 and 122 may be disposed to be perpendicular to the lower surface S1 or the upper surface S2 of the multilayer body 110. That is, the conductive patterns 121 and 122 may be disposed to be perpendicular to the lower surface (mounting surface), which is a surface of the multilayer body facing the board at the time of mounting the multilayer electronic component 100 on the board. Therefore, an axis of the internal coil part 120 may be parallel with respect to the mounting surface of the multilayer body 110.

The conductive metal forming the conductive patterns 121 and 122 is not particularly limited as long as it has excellent electrical conductivity. For example, the conductive metal may be at least one selected from the group consisting of silver (Ag), palladium (Pd), aluminum (Al), nickel (Ni), titanium (Ti), gold (Au), copper (Cu), platinum (Pt), and mixtures thereof.

The first and second external electrodes 131 and 132 may be disposed on both end surfaces S3 and S4 of the multilayer body 110, respectively.

The first and second external electrodes 131 and 132 may be connected to lead portions formed at both ends of the internal coil part 120 and exposed to both end surfaces S3 and S4 of the multilayer body 110, respectively.

The first and second external electrodes 131 and 132 may include band surfaces extended to portions of the lower and upper surfaces S1 and S2 and the side surfaces S5 and S6, adjacent to the end surfaces S3 and S4.

The first and second external electrodes 131 and 132 may be formed of a conductive material, for example, copper (Cu), silver (Ag), nickel (Ni), or the like, but is not limited thereto.

The first and second external electrodes 131 and 132 may be formed by applying a conductive paste prepared by adding a glass frit to a metal powder to the surfaces of the multilayer body and sintering the same.

Figure 3:
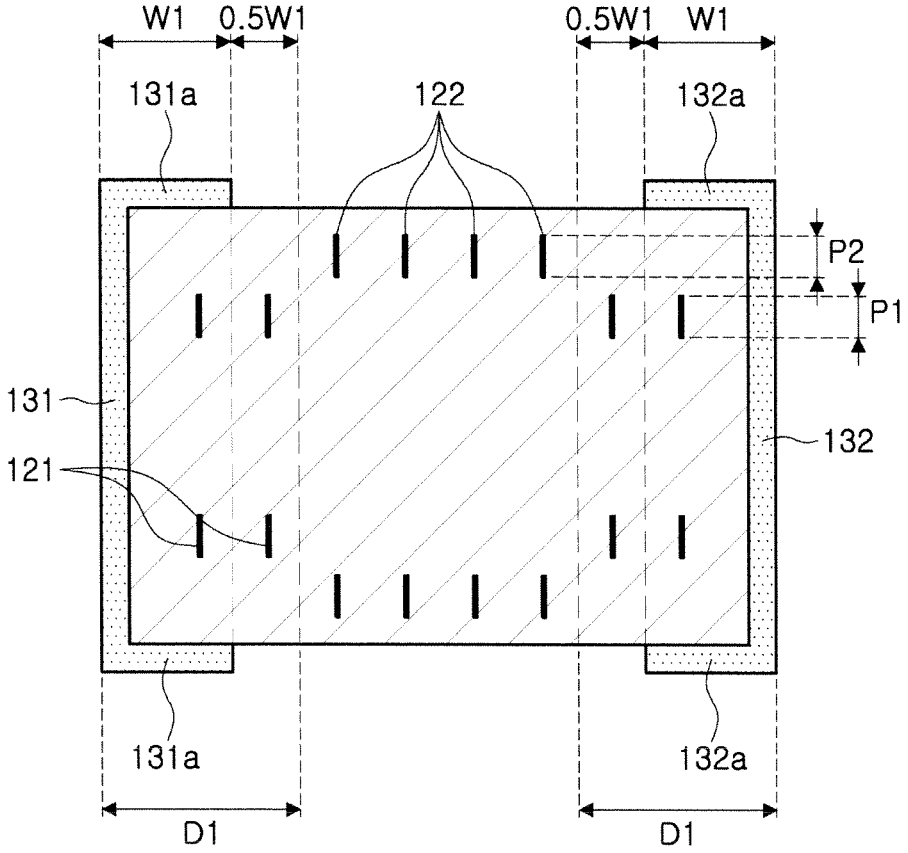
FIG. 3 is a cross-sectional view taken along line I-I' of FIG. 1.

FIG. 3 is a cross-sectional view taken along line I-I' of FIG. 1.

Referring to FIG. 3, when the widths of band surfaces 131*a* and 132*a* of the first and second external electrodes 131 and 132 are defined as W1, the sum of regions of the multilayer body enclosed by the band surfaces 131*a* and 132*a* and regions of the multilayer body extending inwardly from edges of the band surfaces 131*a* and 132*a* by distances 0.5W1 may be defined as D1.

Here, the perimeter of at least one conductive pattern 121 of the conductive patterns disposed inside the regions D1 may be smaller than the perimeters of the conductive patterns 122 disposed outside the regions D1.

The conductive patterns 121 disposed inside the regions D1, the regions adjacent to the first and second external electrodes 131 and 132, have reduced perimeters, such that the distances between the first and second external electrodes 131 and 132 and the conductive patterns 121 are increased, whereby the parasitic capacitance may be decreased.

Here, when a line width of the conductive pattern 121 disposed inside the regions D1 is P1 and a line width of the conductive pattern 122 disposed outside the regions D1 is P2, P1 and P2 may be the same as each other, but are not limited thereto.

Figure 4:
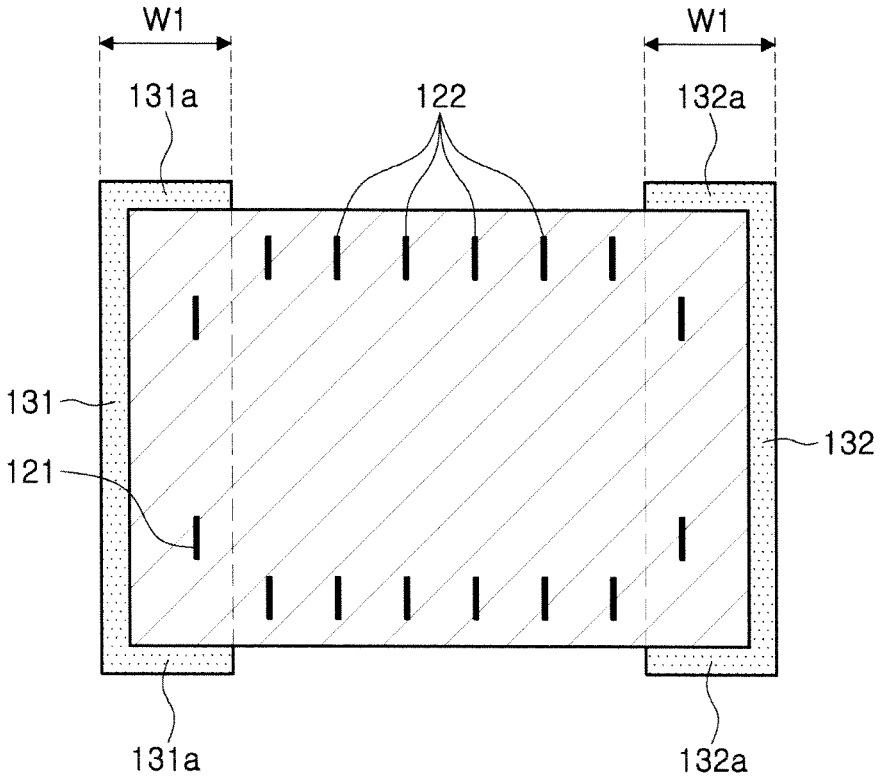
FIG. 4 is a cross-sectional view of a multilayer electronic component according to another exemplary embodiment in the present disclosure.

FIG. 4 is a cross-sectional view of a multilayer electronic component according to another exemplary embodiment in the present disclosure.

Referring to FIG. 4, the perimeter of at least one conductive pattern 121 of the conductive patterns disposed in the regions of the multilayer body enclosed by the band surfaces 131*a* and 132*a* of the first and second external electrodes 131 and 132 may be smaller than the perimeters of the conductive patterns 122 disposed in the region of the multilayer body not enclosed by the band surfaces 131*a* and 132*a*.

Figure 5:
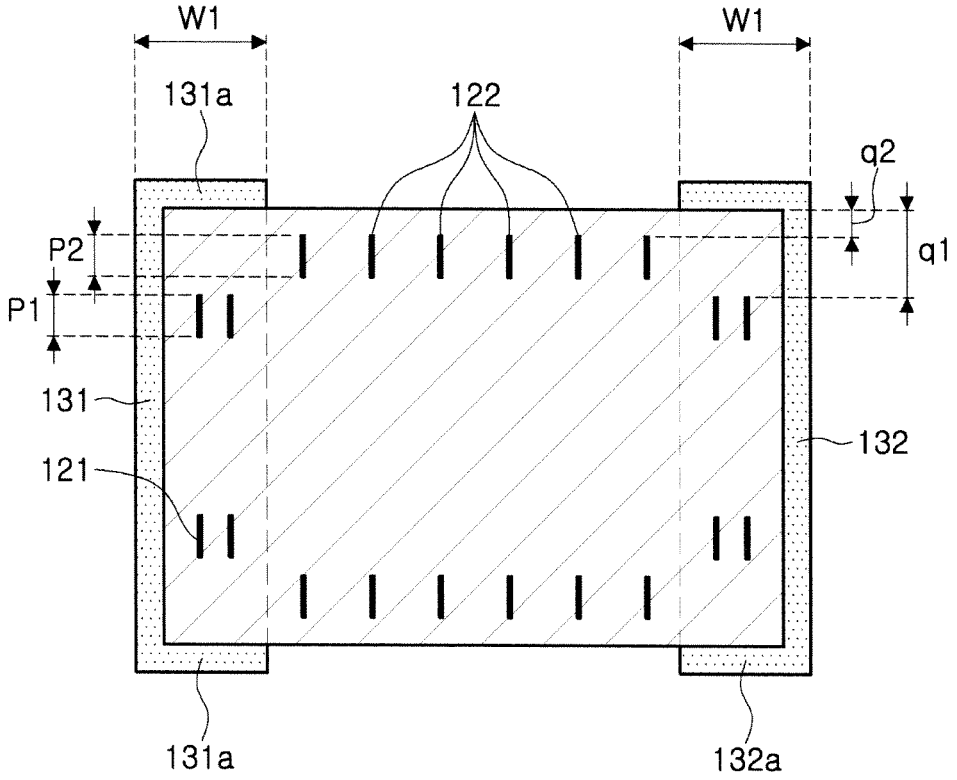
FIG. 5 is a cross-sectional view for describing a distance between a conductive pattern and an upper surface of a multilayer body in a multilayer electronic component according to an exemplary embodiment in the present disclosure.

FIG. 5 is a cross-sectional view for describing a distance between a conductive pattern and an upper surface of a multilayer body in a multilayer electronic component according to an exemplary embodiment in the present disclosure.

Referring to FIG. 5, among the conductive patterns in the multilayer electronic component according to this exemplary embodiment in the present disclosure, a distance from the lower surface S1 or the upper surface S2 of the multilayer body 110 in the thickness T direction to at least one conductive pattern 121 of the conductive patterns disposed in the peripheral regions of the multilayer body may be greater than a distance from the lower surface S1 or the upper surface S2 of the multilayer body 110 in the thickness T direction to the conductive pattern 122 disposed in the central region of the multilayer body among the conductive patterns.

That is, when a distance between the conductive pattern 121 disposed in the peripheral regions and the upper surface S2 of the multilayer body 110 is q1 and a distance between the conductive pattern 122 disposed in the central region and the upper surface S2 of the multilayer body 110 is q2, q1 may be greater than q2.

The distances from the lower surface S1 or the upper surface S2 of the multilayer body 110 to the conductive patterns 121 disposed in the regions of the multilayer body adjacent to the first and second external electrodes 131 and 132 are increased, such that the distances between the first and second external electrodes 131 and 132 and the conductive patterns 121 are increased, whereby parasitic capacitance may be decreased.

Here, when the widths of the band surfaces 131*a* and 132*a* of the first and second external electrodes 131 and 132 are W1, the conductive patterns disposed in the sum of the regions of the multilayer body enclosed by the band surfaces 131*a* and 132*a* and the regions of the multilayer body extending inwardly from edges of the band surfaces 131*a* and 132*a* by distances 0.5W1 may indicate the conductive patterns 121 disposed in the peripheral regions of the multilayer body.

In order to allow the distance from the lower surface S1 or the upper surface S2 of the multilayer body 110 in the thickness T direction to at least one conductive pattern 121 of the conductive patterns disposed in the peripheral regions to be greater than the distance from the lower surface S1 or the upper surface S2 of the multilayer body 110 in the thickness T direction to the conductive pattern 122 disposed in the central region, the perimeter of the conductive pattern 121 disposed in the peripheral region may be smaller than that of the conductive pattern 122 disposed in the central region while the line widths of the conductive patterns 121 and 122 may be the same as each other.

Board Having Multilayer Electronic Component

Figure 6:
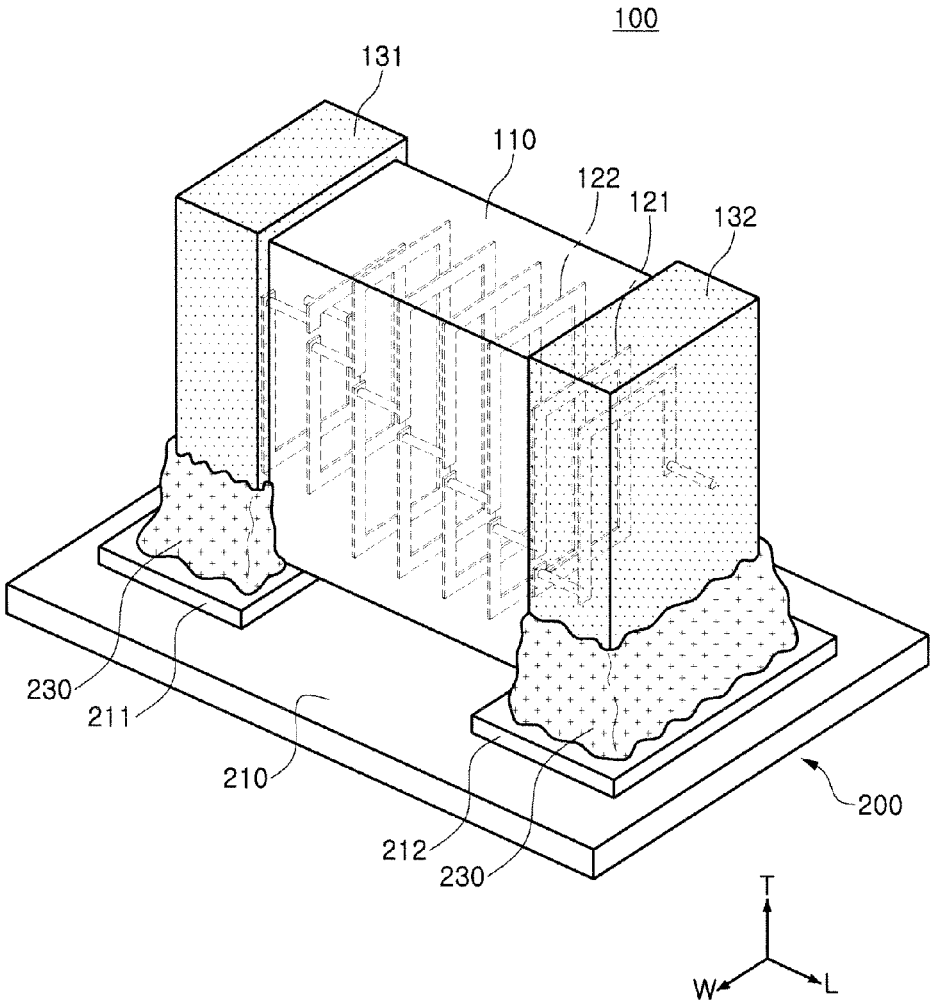
FIG. 6 is a perspective view of the multilayer electronic component of FIG. 1 mounted on a printed circuit board.

FIG. 6 is a perspective view of the multilayer electronic component of FIG. 1 mounted on a printed circuit board.

Referring to FIG. 6, a board 200 having a multilayer electronic component 100 according an exemplary embodiment in the present disclosure may include a printed circuit board 210 on which the multilayer electronic component 100 is mounted, and first and second electrode pads 211 and 212 formed on an upper surface of the printed circuit board 210 to be spaced apart from each other.

Here, the multilayer electronic component 100 may be electrically connected to the printed circuit board 210 by solders 230 in a state in which the first and second external electrodes 131 and 132 thereof are positioned to contact the first and second electrode pads 211 and 212, respectively.

The multilayer electronic component 100 may be mounted on the printed circuit board 210 so that the lower surface S1 thereof in the thickness T direction is disposed to face the upper surface of the printed circuit board 210, and thus, the conductive patterns 121 and 122 of the multilayer electronic component 100 may be disposed to be perpendicular to the printed circuit board 210.

A description of features of the board having a multilayer electronic component, the same as those of the multilayer electronic component described above, will be omitted in order to avoid redundancy.

As set forth above, according to exemplary embodiments of the present disclosure, the perimeters of the conductive patterns disposed in the regions of the multilayer body adjacent to the external electrodes may be reduced, such that the distances between the external electrodes and the conductive patterns are increased, whereby the parasitic capacitance may be decreased.

While exemplary embodiments have been shown and described above, it will be apparent to those skilled in the art that modifications and variations could be made without departing from the scope of the present invention as defined by the appended claims.

What is claimed is:

1. A multilayer electronic component comprising:

a multilayer body including a plurality of insulating layers;

an internal coil part provided by electrically connecting respective conductive patterns disposed on the plurality of insulating layers to each other; and first and second external electrodes disposed on both end surfaces of the multilayer body, respectively, and including band surfaces extending from the end surfaces of the multilayer body to respective edges of the external electrodes, wherein a perimeter of at least one conductive pattern disposed inside a region D1 is smaller than a perimeter of a conductive pattern disposed outside the region D1, where the region D1 is a sum of regions of the multilayer body enclosed by the band surfaces and regions of the multilayer body extending from edges of the band surfaces to the center of the multilayer body by distances 0.5×W1, where W1 is a length of the band surfaces.

2. The multilayer electronic component of claim 1, wherein an axis of the internal coil part is parallel to a mounting surface of the multilayer body.

3. The multilayer electronic component of claim 2, wherein a perimeter of at least one conductive pattern disposed in regions of the multilayer body enclosed by the band surfaces is smaller than a perimeter of a conductive pattern disposed in a region of the multilayer body not enclosed by the band surfaces.

4. The multilayer electronic component of claim 1, wherein the conductive patterns disposed in the region D1 and in the region outside the region D1 have the same line width.

5. The multilayer electronic component of claim 1, wherein a thickness of the multilayer body is greater than a width thereof.

6. A multilayer electronic component comprising:

a multilayer body including a plurality of insulating layers;

an internal coil part provided by electrically connecting respective conductive patterns disposed on the plurality of insulating layers to each other; and first and second external electrodes disposed on both end surfaces of the multilayer body, respectively, wherein the respective distances from upper and lower surfaces of the multilayer body in a thickness direction to at least one conductive pattern disposed in peripheral regions of the multilayer body is greater than the respective distances from the upper and lower surfaces of the multilayer body in the thickness direction to a conductive pattern disposed in a central region of the multilayer body.

7. The multilayer electronic component of claim 6, wherein an axis of the internal coil part is parallel to a mounting surface of the multilayer body, and the first and second external electrodes include band surfaces extended from the end surfaces of the multilayer body to surfaces of the multilayer body adjacent to the end surfaces of the multilayer body.

8. The multilayer electronic component of claim 7, wherein when the sum of regions of the multilayer body enclosed by the band surfaces and regions of the multilayer body extending from edges of the band surfaces to the center of the multilayer body by distances equal to 0.5 times the widths of the band surfaces is D1, a perimeter of at least one conductive pattern disposed inside the regions D1 is smaller than a perimeter of a conductive pattern disposed outside the regions D1.

9. The multilayer electronic component of claim 7, wherein a perimeter of at least one conductive pattern disposed in regions of the multilayer body enclosed by the band surfaces is smaller than a perimeter of a conductive pattern disposed in a region of the multilayer body not enclosed by the band surfaces.

10. The multilayer electronic component of claim 6, wherein the conductive patterns disposed in the peripheral regions and in the central region have the same line width.

11. The multilayer electronic component of claim 6, wherein a thickness of the multilayer body is greater than a width thereof.

12. A multilayer electronic component comprising:

a multilayer body including a plurality of insulating layers, having upper and lower surfaces opposing each other in a thickness direction, both end surfaces opposing each other in a length direction, and both side surfaces opposing each other in a width direction, and having a thickness larger than a width;

an internal coil part provided by electrically connecting respective conductive patterns disposed on the plurality of insulating layers to each other and having an axis that is in parallel to the upper or lower surface of the multilayer body in the thickness direction; and first and second external electrodes disposed on the end surfaces of the multilayer body in the length direction, respectively, and including band surfaces extended from the end surfaces of the multilayer body to respective edges of the external electrodes, wherein a perimeter of at least one conductive pattern disposed inside a region D1 is smaller than a perimeter of a conductive pattern disposed outside the region D1, where D1 is the sum of regions of the multilayer body enclosed by the band surfaces and regions of the multilayer body extending from edges of the band surfaces to the center of the multilayer body by distances equal to 0.5 times the widths of the band surfaces.

13. The multilayer electronic component of claim 12, wherein a distance from the upper and lower surfaces of the multilayer body in the thickness direction to the conductive pattern disposed inside the regions D1 is greater than a distance from the upper and lower surfaces of the multilayer body in the thickness direction to the conductive pattern disposed outside the regions D1.

14. The multilayer electronic component of claim 12, wherein a perimeter of at least one conductive pattern disposed in the regions of the multilayer body enclosed by the band surfaces is smaller than a perimeter of a conductive pattern disposed in a region of the multilayer body not enclosed by the band surfaces.

15. A board having a multilayer electronic component, the board comprising:

a printed circuit board on which first and second electrode pads are disposed; and the multilayer electronic component of claim 1 having the first and second external electrodes installed on the first and second electrode pads, respectively.

16. The multilayer electronic component of claim 1, wherein the respective edges of the external electrodes lie on top and bottom surfaces of the multilayer body between the end surfaces of the multilayer body.

17. The multilayer electronic component of claim 12, wherein the respective edges of the external electrodes lie on top and bottom surfaces of the multilayer body between the end surfaces of the body.

* * * * *